US012503327B2

(12) United States Patent
Nicolaescu

(10) Patent No.: US 12,503,327 B2
(45) Date of Patent: Dec. 23, 2025

(54) METHOD OF WINDING AND PACKAGING WIDE WALLPAPER

(71) Applicant: Gheorghe Nicolaescu, Straseni (MD)

(72) Inventor: Gheorghe Nicolaescu, Straseni (MD)

(73) Assignee: GRAND CANVAS LTD, London (GB)

( * ) Notice: Subject to any disclaimer, the term of this patent is extended or adjusted under 35 U.S.C. 154(b) by 235 days.

(21) Appl. No.: 18/250,076

(22) PCT Filed: Dec. 10, 2020

(86) PCT No.: PCT/MD2020/000005
§ 371 (c)(1),
(2) Date: Apr. 21, 2023

(87) PCT Pub. No.: WO2022/086313
PCT Pub. Date: Apr. 28, 2022

(65) Prior Publication Data

US 2024/0067481 A1 Feb. 29, 2024

(30) Foreign Application Priority Data

Oct. 23, 2020 (MD) ..... md s 2020 0134

(51) Int. Cl.
*B65H 18/28* (2006.01)
*B65B 25/14* (2006.01)
*B65B 63/04* (2006.01)

(52) U.S. Cl.
CPC ..... *B65H 18/28* (2013.01); *B65B 63/04* (2013.01); *B65B 25/146* (2013.01); *B65H 2701/1922* (2013.01)

(58) Field of Classification Search
CPC ..... B65B 25/146; B65B 25/148; B65B 63/04; B65H 75/242; B65H 75/243; B65H 2701/1922; B65H 18/04; B65H 18/28
(Continued)

(56) References Cited

U.S. PATENT DOCUMENTS 3,139,242 A * 6/1964 Banlier ..... B65H 49/06 242/571.1
3,300,211 A 1/1967 Maring
(Continued)

FOREIGN PATENT DOCUMENTS

AU 611110 B2 6/1991
CN 1778660 A 5/2006
(Continued)

OTHER PUBLICATIONS

International Search Report for PCT/MD2020/000005 mailed on Aug. 3, 2021.

*Primary Examiner* — Thanh K Truong
*Assistant Examiner* — Linda J. Hodge
(74) *Attorney, Agent, or Firm* — Dennemeyer & Associates LLC

(57) ABSTRACT

The invention relates to a method of winding and packaging wide wallpaper, which is wound around a roll on a winding and rotary device, followed by packaging wallpaper in containers for transportation or storage. In the first embodiment of the invention, in the presented process, winding of the wallpaper (3) is carried out onto a winding and rotation mechanism, made in the form of a finished hollow closed cylindrical tube (1) of flexible material, equipped with a valve (2) for supplying and discharging air from it. At the same time, the valve (2) is fixed on one of the tube bases (4). Along the length of the pumped cylindrical tube (1) is fixed the edge of the wallpaper (3) and wound it on the tube (1) until a roll of the required length is obtained. In the second embodiment of the invention, the tube for wallpaper winding is formed from a part of a whole piece of wallpaper material (6) separated from the edge (7) in the form of a fold along the width of the wallpaper. The selected part of the wallpaper material, corresponding to the diameter of the tube (9) being created, is laid in width in two layers and
(Continued)

fastened along the perimeter of the formed sides. The valve (10) is installed on one of the bases of the cylindrical tube (9) formed when air is pumped. The rest of the whole piece of wallpaper is wound on the tube (9) until a roll of the required length is obtained. Further, in both embodiments of the described method, the air is released from the tube through the valve to form a flat rectangular structure in the form of wallpaper layers with a tube placed inside. The resulting structure is laid into several layers for packaging in containers and subsequent storage and transportation. Flexible materials such as paper, vinyl, PVC, polyethylene and others are used as material for the manufacture of the tube.

2 Claims, 5 Drawing Sheets

(58) Field of Classification Search
USPC ..... 53/429, 430, 118; 206/389; 242/160.4, 242/571.1
See application file for complete search history.

(56) References Cited

U.S. PATENT DOCUMENTS

| | | | | | |
|---|---|---|---|---|---|
| 3,865,325 | A | * | 2/1975 | Newcomer, Jr. ..... | B65H 75/00 242/160.3 |
| 4,597,494 | A | * | 7/1986 | Benoit ..... | B65D 83/0894 206/390 |

FOREIGN PATENT DOCUMENTS

| | | | | | |
|---|---|---|---|---|---|
| DE | 4106972 | | * | 9/1991 | ..... B65B 25/146 |
| DE | 000010313522 | A1 | | 10/2004 | |
| GB | 1070280 | A | | 6/1967 | |
| JP | 200559970 | | * | 3/2005 | ..... B65H 18/04 |
| JP | 2005059970 | A | | 3/2005 | |
| JP | 2005082372 | A | | 3/2005 | |
| WO | 2014/080224 | A1 | | 5/2014 | |

* cited by examiner

METHOD OF WINDING AND PACKAGING WIDE WALLPAPER

The invention relates to a method of winding and packaging wide wallpaper, which is wound around a roll on a winding and rotary device, followed by packaging wallpaper in containers for transportation or storage.

There are known various methods and devices for packaging the wallpaper, the main function of which is winding wallpaper around a hollow cylinder, so that cylindrical rolls are formed for subsequent transportation and their further use in construction processes.

The most common way of packaging wallpaper is to wind it onto a hollow cylindrical surface such as a tube.

So, it is known a roller, which is a hollow cylindrical tube for winding wallpaper along its length, in which the tube is equipped with plugs at the ends [1]. It virtually demonstrates a standard basic approach to the method of forming packages for wallpaper.

It is known a packaging device for winding materials in the form of a web, for example, fabrics, nonwovens, wallpaper, etc., described in patent No. EP1145989 (A2) [2].

According to the solution presented therein, a rigid pipe having a cylindrical shape in cross section serves as a core for winding material, in particular wallpaper. This pipe is closed at both ends and contains a waterproof film container, which in turn is placed in a cavity surrounded by the pipe. The waterproof container is a tubular film container adapted to the cross section and dimensions of the pipe.

Wallpaper is wound on the rigid tube acting as a winding core, with a waterproof container inserted into the cavity.

At the same time, the pipe is at both ends equipped with insertable or attachable transport fasteners, which have a flange adapted to the inner or outer diameter of the pipe and a rectangular or square base plate. The length and width of each plate is greater than the diameter of the roll formed from the material being wound onto the pipe.

As a result of the actions carried out on the components of the packaging device, the tube with the wound material is protected on both sides.

The device can use a film container, closed by a weld scam and filled with solid, liquid or pasty material.

The disadvantage of the described technical solution is its rather inconvenient design both for the process of assembling products and for their subsequent transportation and use.

It should be noted that in the above examples, rolls resembling small narrow tubes with a limited height, approximately in the range from 40 cm to 110 cm, are considered as a form for wallpaper. When using such wallpaper for wall covering there are a large number of seams between stripes, which come off and become loose over time, spoiling the overall picture.

Wide wallpaper has been designed to achieve a "seamless" effect.

The closest in technical essence to the claimed invention is a wide wallpaper winding device, set forth in the Chinese patent No. CN 203889729 (U) [3].

This patent deals with the possibility of winding and packaging wide wallpaper by winding it on a cylindrically shaped winding and rotary device providing, during rotation, for the uniform winding of wallpaper thereon, forming a roll consisting of successive wraps overlapped one over another.

To solve this problem, in the patent the winding and rotary device is placed above the base and contains wall panels, between which a number of support pipes, conditionally forming the cylindrical shape of the winding and rotary device, are attached.

Coupling rings are fixed to the both ends of each support pipe and attached to aluminum guide rollers. In the middle of each wall panel, a transmission gear is fixed. Rotating gears connect the outer rings of the wall panels.

As the aluminum guide rollers rotate, the wallpaper are never damaged by scratches on the support pipes.

The patented technical solution prevents the wallpaper from deflecting or uneven winding.

However, the design of this winding device is a complex technical structure, the creation of which requires a large number of different mechanical parts, their exact correlation during assembly and, thus, a complex process of initiating and running the wide wallpaper winding process.

Technologically obtained wide wallpaper for delivery to the place of use are subject to packaging, but this procedure is not considered in the patent, while in fact it is not simple and requires additional labor and financial costs.

The technical problem to be solved by this invention consists in the development of the methods of winding and packaging wide wallpaper, which, upon completion of winding the wallpaper, provides for a process of convenient and inexpensive maintenance when placing and packing it in containers for transportation or storage.

To solve the problem with the achievement of the specified technical result, at least two embodiments of the invention are possible.

According to the first embodiment of the invention, the problem is to he solved due to the fact that in the method of winding and packaging wide wallpaper by winding the wallpaper on a cylindrically shaped winding and rotary device providing, during rotation, for the uniform winding of wallpaper thereon, forming a roll consisting of successive wraps overlapped one over another, the winding and rotary device is made in the form of a hollow closed cylindrical tube made of flexible material, equipped with a valve, through which air is pumped into the tube to form its cylindrical shape, the wallpaper edge is fixed along the length of the pumped cylindrical tube and the wallpaper is wound onto the tube until a roll of the required length is obtained, air is released from the tube through the valve until a flat structure is obtained in the form of wallpaper layers with a tube placed inside, the resulting flat structure is laid in several layers for packaging in containers for transportation or storage with the possibility of subsequent pumping of the tube to a cylindrical shape.

In addition, in this embodiment, the edge corresponding to the width of the wallpaper is fixed along the length of the cylindrically shaped tube using fixing means such as glue, adhesive tape or other fixing means.

According to the second embodiment of the invention, the problem is solved due to the fact that in the method of winding and packaging wide wallpaper by winding the wallpaper on a cylindrically shaped winding and rotary device providing, during rotation, for the uniform winding of wallpaper thereon, forming a roll consisting of successive wraps overlapped one over another, the winding and rotary device is made in the form of a hollow closed cylindrical tube made of flexible material, equipped with a valve, through which air is pumped into the tube to form its cylindrical shape, the lube is formed from a part of a single piece of wallpaper material, selected along the width of the wallpaper from the edge in the form of a fold, providing the set size of the tube diameter, the selected part of the wallpaper material is laid in two layers along the width and the layers are fastened along the perimeter of the formed sides, the rest of the wallpaper roll is wound onto the tube until a roll of the required length is obtained; air is released from the tube through the valve until a flat structure is obtained in the form of wallpaper layers with a tube placed inside, the resulting flat structure is laid in several layers for packaging in a container for transportation or storage with the possibility of subsequent pumping of the tube to a cylindrical shape.

At the same time, in both embodiments of the methods, the valve is installed on one of the bases of the cylindrical tube, and the materials used for the tube manufacture are, for example, vinyl, PVC, polyethylene and other flexible materials.

The technical result achieved with the help of embodiments of the claimed invention consists in simplifying the technological process of winding and packaging wide wallpaper, and also, as a consequence, in reducing financial and labor costs for performing work on its maintenance.

This result is achieved due to the fact that in both embodiments of the claimed methods, a simple and inexpensive device for winding wallpaper in the form of a flexible cylindrical tube equipped with a valve for pumping air into it, is used.

The dimensions of the tube, purchased separately in the first embodiment, can be easily selected for any specific width of wallpaper sizes, including for wallpaper made with one web for the entire covered wall area. At the same time, the specialized manufacture of such tubes of both standard and individual sizes in length and diameter for specific wallpaper, presents no difficulty either technologically or financially.

In turn, in the second embodiment, the formation of a tube from the wallpaper material is technologically not only a simple and cheap process, but also greatly simplifies the auxiliary steps for its use when winding the wallpaper.

The process of obtaining a flat design in the form of wallpaper layers with a tube placed inside is ensured in both embodiments by simply releasing air from the tube through a valve.

For both embodiments of the method, the subsequent laying of the flat structure and its packaging in containers for transportation or storage is a simple standard operation.

In the process of implementing the claimed method, inexpensive equipment and widely available auxiliary technical materials are used, which does not require serious financial costs.

An obvious advantage of this invention is the possibility of subsequent convenient use of the packed wide wallpaper in the process of hanging to the wall Indeed, the claimed method makes it possible to hang wallpaper with a single web over the entire work surface, which greatly simplifies the installation procedure by reducing the number of operations performed when hanging wallpaper.

Ultimately, the proposed embodiments of the methods are easy-to-use, easy-to-work and provide reliable safety of the final product, compactly packed in a container for transportation or storage of a wallpaper roil, excluding the possibility of harmful effects of external environmental factors on the packed material, preventing its contamination and loss of consumer properties.

Moreover, the guaranteed possibility of compact packaging of wide wallpaper according to this invention significantly increases the availability and reduces the cost of their transportation to the place of installation.

Summary of the invention is illustrated by the following description and drawings.

According to the first embodiment of the method:

Figure 5:
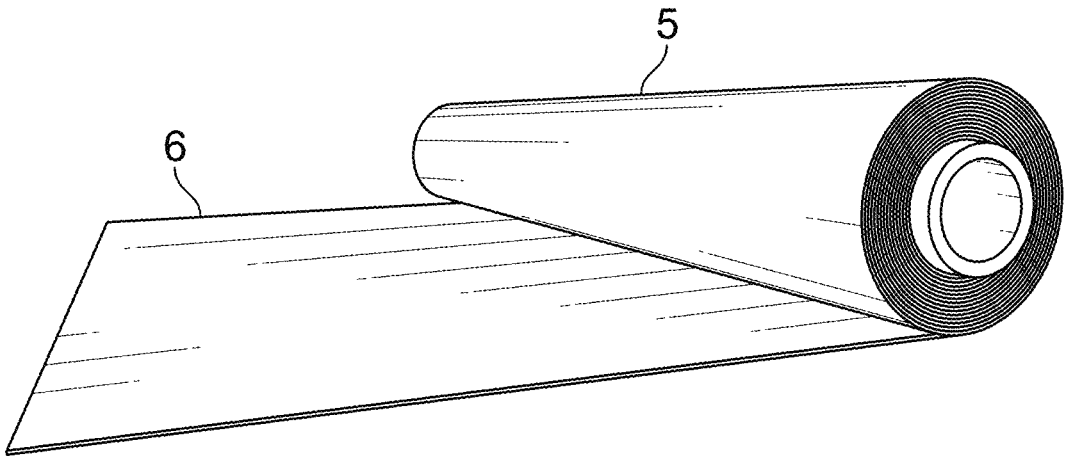
Figure 6:
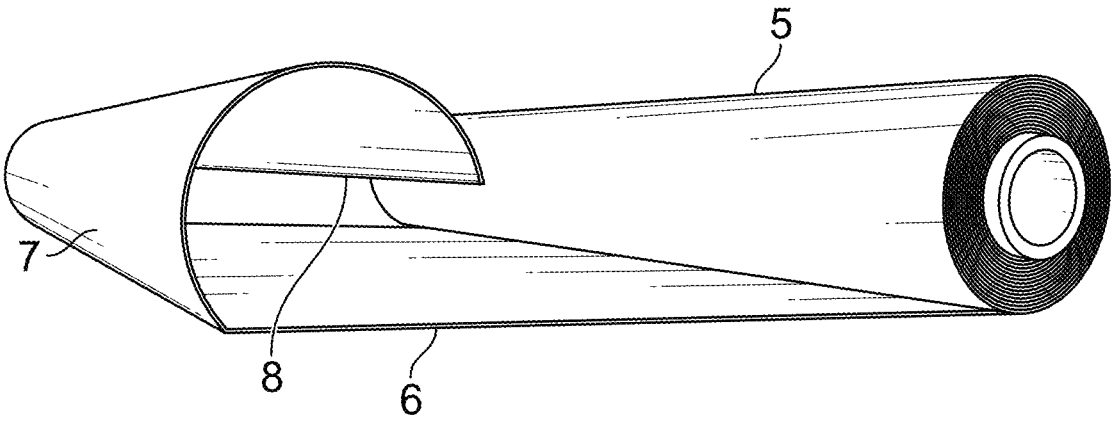
Figure 7:
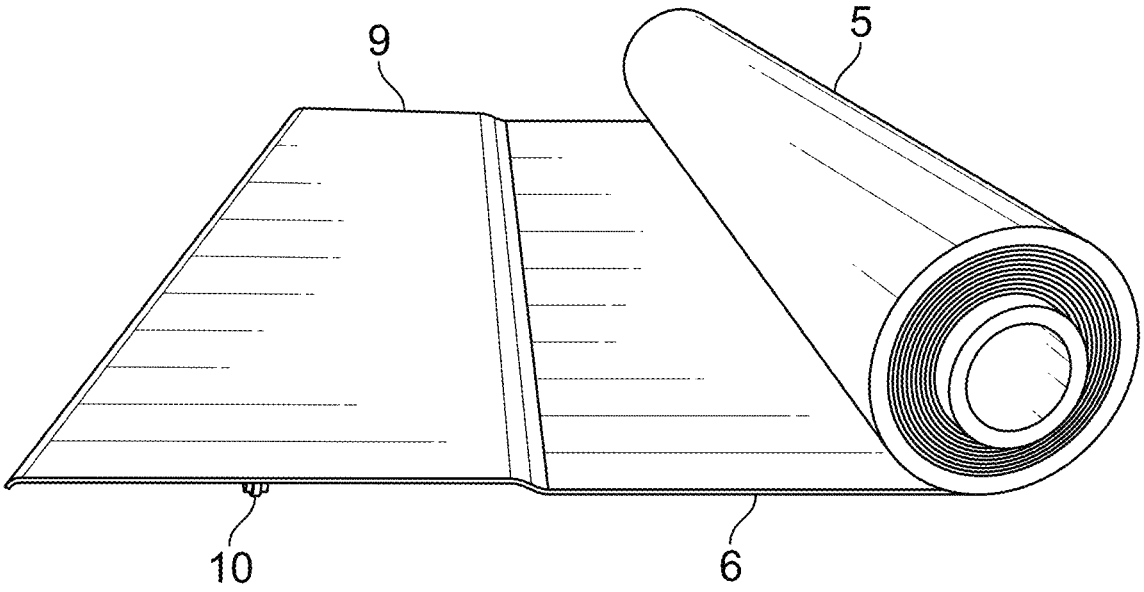
Figure 8:
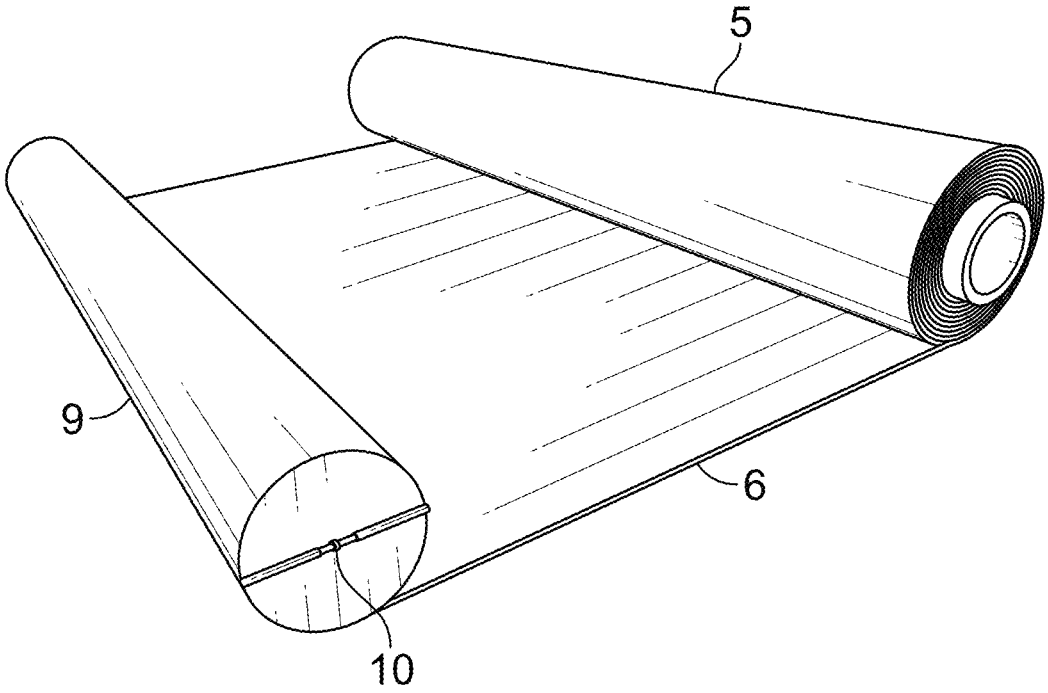
Figure 9:
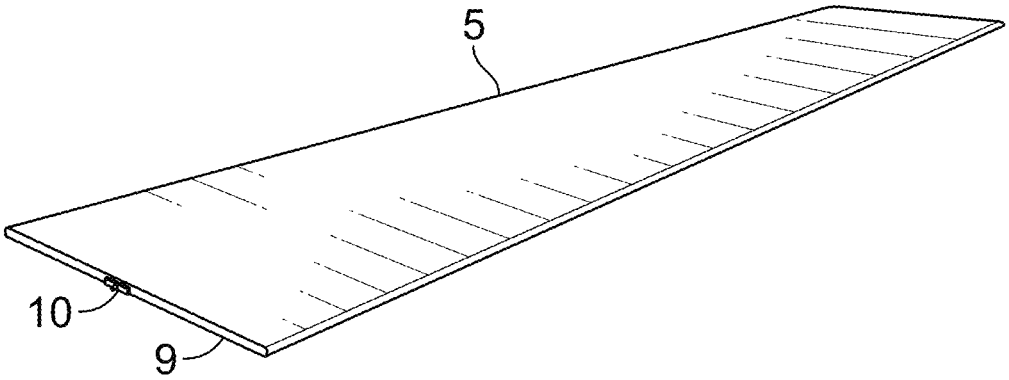
Figure 10:
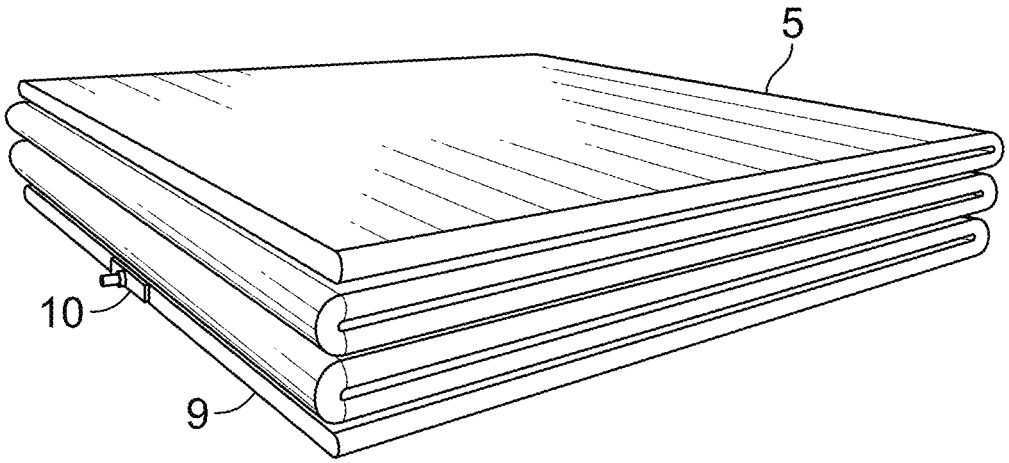

According to the second embodiment of the method:

FIG. 5 shows a wallpaper roll with a part of the spread out web;

FIG. 6 shows a wallpaper roll with an isolated segment for the tube;

FIG. 7 shows a wallpaper roll with an executed tube;

FIG. 8 shows a tube ready for winding wallpaper;

FIG. 9 shows a tube with released air with a roll wound thereon;

FIG. 10 shows a roll of wallpaper packed with a tube.

The methods are implemented as follows.

Figure 1:
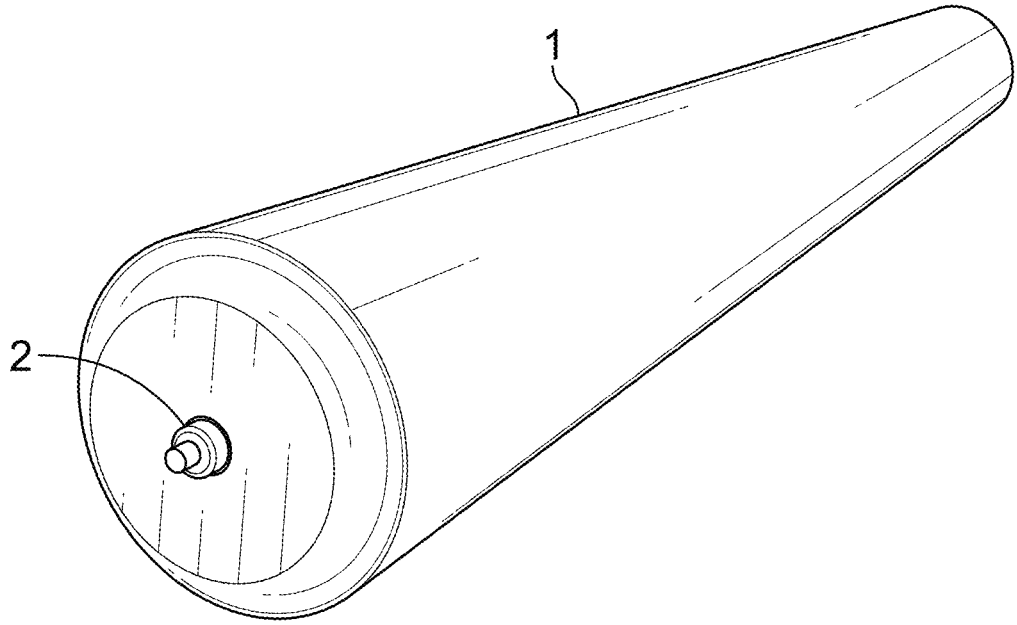
FIG. 1 shows an air-pumped tube.
Figure 2:
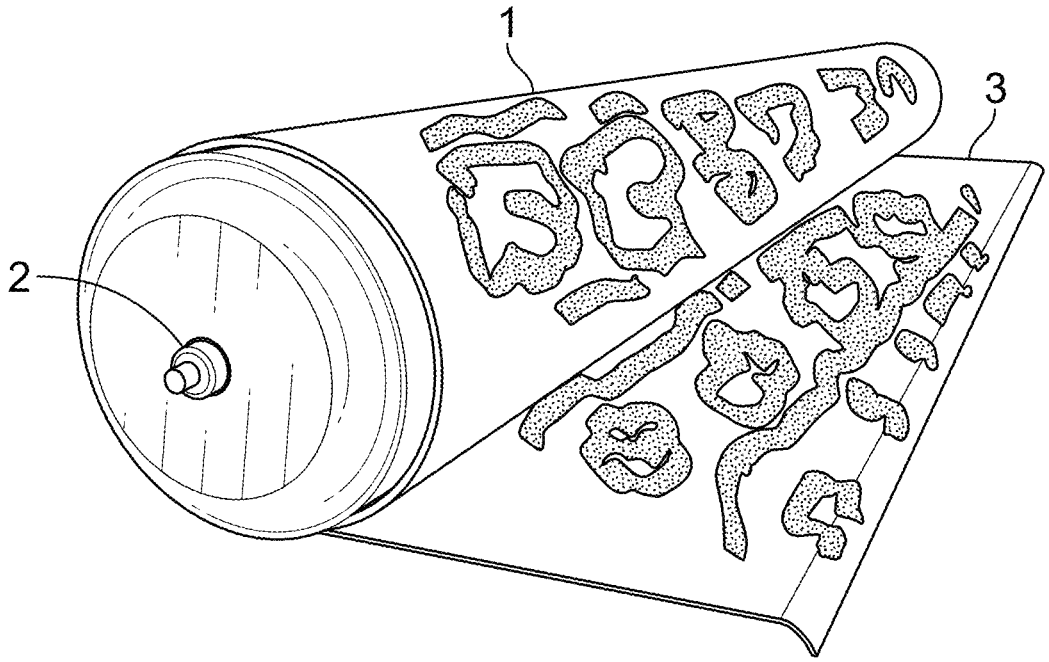
FIG. 2 shows an air-pumped tube with a roll of wallpaper wound around it.
Figure 3:
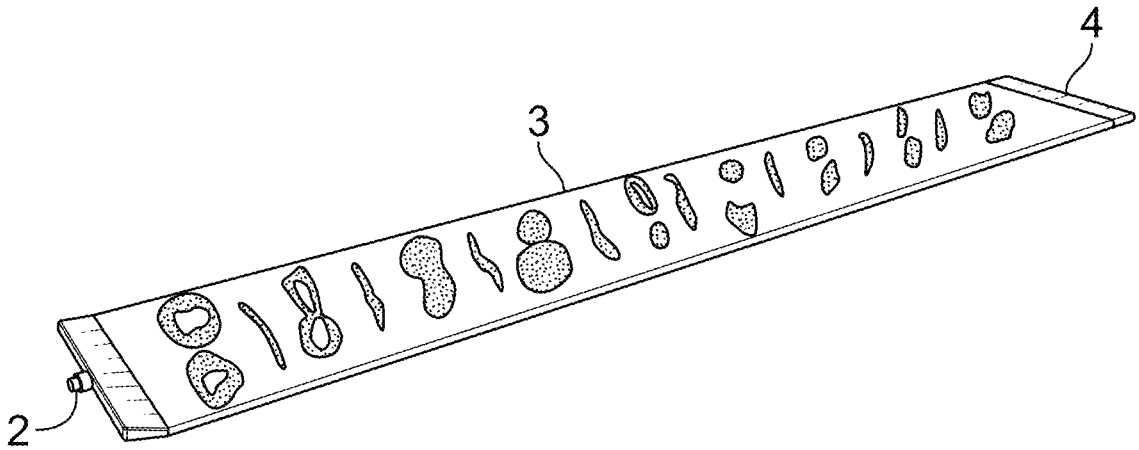
FIG. 3 shows a tube with released air with a roll of wallpaper wound around it.
Figure 4:
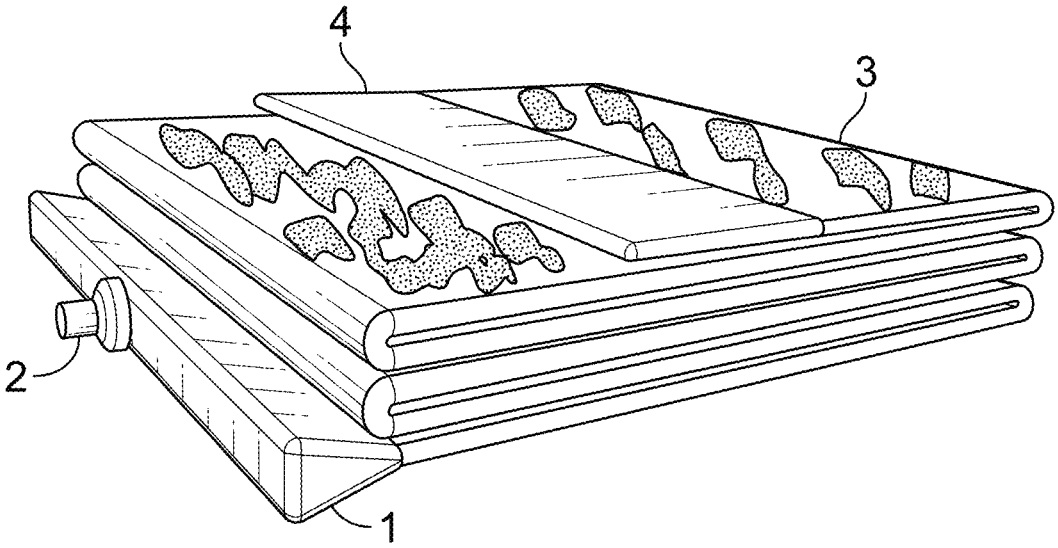
FIG. 4 shows a roll of wallpaper packed with a tube.

According to the method of winding and packaging wide wallpaper made of flexible material, in accordance with the first embodiment (FIGS. 1, 2, 3, 4), depending on the parameters of the wallpaper to be packed, a tube 1 made in the form of a cylinder (FIG. 1) is selected, having a length corresponding to the width of the wallpaper. Through valve 2, placed, for example, in one of the bases of the tube, air is pumped into the tube to form a rigid cylindrical shape capable of holding the wallpaper wound on it in a vertical position during the process of hanging it on the walls.

The cylindrical tube is placed on an auxiliary working device, convenient for subsequent actions, and the edge of the wallpaper width is fixed on the tube along its length so that the wallpaper roll is parallel to the tube. Then, carefully turning the tube, the wallpaper web 3 is evenly wound on it (FIG. 2), tracking the achievement of the smooth surface of its winding.

As a result, a fully wound roll of wallpaper is obtained, the width and length of which is determined by the required dimensions, corresponding to the dimensions of the wall surface to be papered.

Further, from the tube 1 with a wallpaper roll wound on it through the valve 2, air contained in it is released until a flat rectangular product is obtained (FIG. 3), formed by the wallpaper 3 with a flat tube 1 inside it, represented along the length on both sides by segments of flattened bases 4.

The resulting rectangular product is laid in layers on each other (FIG. 4) and then hermetically packed in a container of suitable size for subsequent transportation or storage. At the same time, the dimensions of the layers, and therefore their number, correlate with the dimensions of the inner volume of the selected container.

According to the method of winding and packaging wide wallpaper made of flexible material, in accordance with the second embodiment (FIG. 5, 6, 7, 8), the structure of the tube for the selected wallpaper to be packaged is formed from the material of the wallpaper, shown in the form of a single roll 5 with a part of the spread out web 6 (FIG. 5). From the part of the spread out web 6, bending it along the width of the wallpaper from the edge 7 towards the roll 5, a segment 8 (FIG. 6) is isolated to form a tube. When forming the tube, the wallpaper material of the segment 8 is laid into 2 layers and the layers are fastened along the perimeter of the sides. As a result, a tube 9 is obtained from the wallpaper material and a valve 10 is installed on one of its short sides (FIG. 7).

Then, as in the first embodiment, air is pumped through the valve 10 inside the tube 9 to form it in a rigid cylindrical shape. Gently turning the tube, the wallpaper web of the roll 5 is evenly wound on it (FIG. 8), monitoring the achievement of a smooth surface of its winding.

As a result, a fully wound roll of wallpaper is obtained, the width and length of which is determined by the required dimensions, corresponding to the dimensions of the wall surface to be papered.

Further, from the tube 9 with a roll of wallpaper wound on it through the valve 10, air contained in it is released until a flat rectangular product is obtained (FIG. 9), formed by the wallpaper roll 5 with a flat tube 9 inside it.

The resulting rectangular product is laid in layers on each other (FIG. 10) and then hermetically packed in a container of suitable size for subsequent transportation or storage. At the same time, the dimensions of the layers, and therefore their number, correlate with the dimensions of the inner volume of the selected container.

It should be noted that in both embodiments of the method, different materials, for example, vinyl, PVC, polyethylene and other flexible materials, can be used for the wallpaper wound around a cylindrical tube. Moreover, paper can also be used as the wallpaper material for the first embodiment of the process.

If desired, a consumer who has bought wide wallpaper can unpack the purchased roll of packed wallpaper and, having carried out all the packing procedures in the reverse order, ultimately get the opportunity to independently carry out the wallpaper hanging procedure.

Example of a Specific Implementation of the Method

When developing the above-described embodiments of the method of winding and packaging wide wallpaper, an experimental test was carried out for the possibility of their implementation.

Embodiment 1. Standard fabric wallpaper with a width of 2.7 m and a length of 5.0 m, wound in the form of a roll was used to conduct the experiment.

To wind such a wallpaper roll on a tube, a sample was purchased in the form of a hollow closed cylindrical product, the length of which was 2.75 m and corresponded to the width of the wallpaper, and its diameter was equal to 0.3 m. Such a tube further in the process of the experiment made it possible to confidently put it vertically with the wallpaper.

Through a Lightblue Spiral valve [4], installed on one of the bases of the cylindrical tube, air was pumped into it using a Intex 68605 pump [5] until a rigid cylindrical shape ensuring a stable vertical position of the pumped tube, was formed.

The pumped tube was placed along its length on an auxiliary device and the edge of the wallpaper was fixed on its cylindrical surface parallel to the axis using double-sided adhesive tape. With the subsequent rotation of the tube parallel to its axis, wallpaper was evenly wrapped around it so that a certain cylindrical structure was formed.

Then, opening the valve, air was released from the tube until a flat structure, consisting of layers of wallpaper and a flat tube placed in its center between the wallpaper, was obtained.

Given its full length, the resulting product was laid in serpentine layers of 0.4 m on each other, so that a compact structure of a 0.3 m high, 0.4 m long and 0.4 m wide was formed. This structure was packed in a cardboard box of 0.5 m×0.4 m×0.3 m in size for storage.

Thus, this method ensures a convenient solution to the problem of winding and packaging wide wallpaper, which can be effectively used for various economic purposes.

Embodiment 2. In the course of this experiment, standard fabric wallpaper of a width of 2.7 m and a length of 6.0 m, wound in the form of a roll was used, as in the first embodiment. From the edge of the roll, which is in a horizontal position, along its width, a part of the web of a length of 0.95 in was unwound, providing for, when forming a cylinder, the obtaining of a diameter of 0.3 m.

The unwound part of the wallpaper length web was folded across the width and stitched along the edge of the sides, forming a closed rectangular volume. A Lightblue Spiral [4] valve was hermetically sealed in the middle of one of the short sides of the rectangle. Air was pumped into it through the valve using a Intex 68605 pump [5] until a rigid cylindrical tube with a diameter of 0.3 m and a length of 2.7 m was formed.

The pumped tube, together with the rest of the wallpaper roll coupled with it, was placed lengthwise on an auxiliary device. With the subsequent rotation of the tube parallel to its axis, the roll wallpaper was uniformly wound on it so that a certain cylindrical structure was formed.

Then, opening the valve, air was released from the tube to obtain a flat structure consisting of layers of fabric wallpaper and a flat tube of the same material placed in its center between the wallpaper.

As in the first embodiment, the resulting product was laid in serpentine layers 0.4 m in size on each other, so that a compact structure 0.3 m high, 0.4 m long and 0.4 m wide was formed. This structure was packed in a cardboard box of 0.5 m×0.4 m×0.3 m in size for storage.

Thus, this method ensures a convenient solution to the problem of winding and packaging wide wallpaper, which does not require additional devices and can be effectively used for various economic purposes.

What is claimed is:

1. A method of winding and packaging a sheet of wide wallpaper having at least an edge and a dimension corresponding to a vertical dimension of a wall onto which the wide wallpaper is to be affixed, for storage, transportation and use, comprising:

creating a cylindrically shaped winding core having a longitudinal axis, the cylindrical shape comprising a tube formed from a part of a single piece of wallpaper material, in the form of a fold, the wallpaper material being laid in two layers along a width and the layers being fastened together along edges of the two layers, thereby defining a tube diameter;

providing a valve in at least one of the edges of the two layers, through which gas can be pumped into the tube to form the cylindrical shape;

inflating the tube by inserting gas therein, through the valve such that the winding core forms a hollow closed cylindrical tube of wallpaper;

rolling the winding core so that the wallpaper is wound onto the winding core until a roll of a desired length is obtained, releasing gas through the valve until a flat structure is obtained in the form of wallpaper layers with the tube placed inside;

the resulting flat structure being folded along the longitudinal axis and laid in several layers of folds for packaging in a container for transportation or storage or subsequent pumping of gas into the tube to again form a cylindrical shape; and subsequently unfolding and reinflating the flat structure to again form a winding core from which wide wallpaper can be directly unwound and affixed onto a wall.

2. A method according to claim 1, wherein the material used for the wallpaper includes; vinyl, PVC, polyethylene and other flexible materials.

* * * * *